US007188445B2

(12) United States Patent
Lehman

(10) Patent No.: US 7,188,445 B2
(45) Date of Patent: Mar. 13, 2007

(54) CANTILEVERED GUN REST

(76) Inventor: Kenneth J. Lehman, 4751 S. Johnson Rd., Gowen, MI (US) 49326

( * ) Notice: Subject to any disclaimer, the term of this patent is extended or adjusted under 35 U.S.C. 154(b) by 84 days.

(21) Appl. No.: 11/128,847

(22) Filed: May 13, 2005

(65) Prior Publication Data

US 2006/0254114 A1 Nov. 16, 2006

(51) Int. Cl.
*F41C 27/22* (2006.01)
*F41A 23/00* (2006.01)

(52) U.S. Cl. ..... 42/94; 248/125.8

(58) Field of Classification Search ..... 42/94; 89/37.01, 37.04; 248/125.1, 125.8
See application file for complete search history.

(56) References Cited

U.S. PATENT DOCUMENTS 1,195,055 A * 8/1916 McNeal ..... 89/37.04
2,582,140 A * 1/1952 Leek ..... 89/44.01
4,007,554 A * 2/1977 Helmstadter ..... 42/94
D257,687 S * 12/1980 Bechtel ..... D22/108
4,854,066 A * 8/1989 Canterbury, Sr. ..... 42/94
4,967,497 A * 11/1990 Yakscoe ..... 42/94
5,666,757 A * 9/1997 Helmstadter ..... 42/94
5,778,589 A * 7/1998 Teague ..... 42/94
5,913,667 A * 6/1999 Smilee ..... 42/94
5,913,668 A * 6/1999 Messer ..... 42/94
5,964,435 A * 10/1999 Peltier ..... 248/166
6,283,428 B1 * 9/2001 Maples et al. ..... 248/282.1
6,574,899 B1 * 6/2003 Mostello ..... 42/94
6,684,550 B2 2/2004 Highfill
6,871,440 B2 * 3/2005 Highfill et al. ..... 42/94
7,066,365 B2 * 6/2006 Brown ..... 224/401
7,086,192 B2 * 8/2006 Deros ..... 42/94

* cited by examiner

*Primary Examiner*—Michael J. Carone
*Assistant Examiner*—Bret Hayes
(74) *Attorney, Agent, or Firm*—Ian C. McLeod; Steven E. Merritt

(57) ABSTRACT

A rotatable cantilevered gun rest (10) capable of being mounted upon a fixed support such as a wall in a hunting blind. The gun rest (10) can be rotated 180° to allow for sighting along any horizontal angle with respect to the wall. A proximal yoke (50) and a distal yoke (70) are used to support the gun. The distal yoke (70) is vertically adjustable to provide variable vertical sighting angles.

28 Claims, 6 Drawing Sheets

CANTILEVERED GUN REST

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates generally to gun rests for handheld long guns, and more particularly to a gun rest which can be mounted on the wall of a hunting blind. Specifically, the present invention relates to a vertically adjustable and horizontally rotating cantilevered gun rest mountable in a hunting blind.

(2) Description of the Related Art

U.S. Pat. No. 4,007,554 to Helmstadter discloses a rifle rest which can be angularly rotated and elevationally pivoted to sight the rifle on a target. A cradle member of the rest can be elevationally manipulated by pivoting a bar member on a pivot bolt. It is vertically shifted by moving a ring member fitted onto a unipod support to a desired height and fastened with a thumb screw placed in one of a series of indentations or holes.

U.S. Pat. No. 4,854,066 to Canterbury, Sr. discloses a rifle rest comprising a member having one end which holds the back of the rifle and the other end is supported by a sleeve which can freely rotate around a tubular standard. The rifle rest additionally has a loosely fitted U-shaped yoke on top of the tubular standard for holding the front of the rifle so as to also freely rotate. The tubular standard fits over a rod which is pointed at one end for implanting into the ground. The rifle rest is not mountable on a wall or rotate as a unitary structure.

U.S. Pat. No. 5,964,435 to Peltier comprises a non-rotating gun rest. The gun rest has two legs which are capable of being hooked over the edge of a wall or window in a hunting blind or stand. The gun rest is held up by a brace having a threaded post at one end which rests against the wall. The brace is locked in an extended position by means of a hinge.

U.S. Pat. No. 6,684,550 to Highfill discloses a mounting system for a clay target thrower and rifle/pistol rest which is attachable to a vehicle trailer hitch. The thrower can be turned right or left up to 180° wand then locked into position with a fastener.

While the related art teach gun rests, there still exists a need for an adjustable rotating gun rest capable of being mounted in a blind.

OBJECTS

Therefore, it is an object of the present invention to provide an improved gun rest.

It is further an object of the present invention to provide a vertically and horizontally adjustable gun rest which is cantilevered and can be mounted to a fixed surface.

These and other objects will become increasingly apparent by reference to the following description.

SUMMARY OF THE INVENTION

The present invention provides a rest for steadying a handheld long gun during firing having a stock with a butt end and a barrel end, comprising: a mounting means for mounting of the rest on a fixed surface; a support means with ends, a first end of which is affixed to the mounting means and with a rotatable bearing means which provides for rotation of a rotating portion of the support means at a second end on a vertical axis; a frame with a proximal end and a distal end, the proximal end cantilevered on the portion for rotation of the support means which is mounted at the distal end of the frame, the frame having a top side and a bottom side; a proximal yoke means for supporting the butt end of the gun on the proximal end of the frame; and a distal yoke means mounted on the top side of the distal end of the frame for supporting the barrel end of the gun, wherein a horizontal angle of a sighting line of the gun in the rest is changed by rotating the frame on the rotatable bearing of the support means.

In further embodiments the rest further comprises one or more wedges held between the mounting means and the fixed surface when the rest in mounted to offset a vertical sighting angle of the gun in the rest with respect to the horizon. In still further embodiments the proximal yoke is V-shaped, such that the butt end of the stock can be supported at various places along a length of the butt end. In still further embodiments the fixed surface is part of a hunting blind. In still further embodiments the fixed surface is a wall of the hunting blind.

The present invention provides a rest for steadying a rifle during firing with a butt end of a stock and a barrel end, the rifle fired in a generally declined angular direction from horizontal comprising: a mounting means for mounting of the rest on a fixed surface; a support means with ends, a first end of which is affixed to the mounting means and with a rotatable bearing means which provides for rotation of a rotating portion of the support means at a second end on a vertical axis; a frame with a proximal end and a distal end, the proximal end cantilevered on the rotating portion of the support means which is mounted at the distal end of the frame, the frame having a top side and a bottom side; a proximal yoke means for supporting the butt end of the gun on the proximal end of the frame; a vertical adjustment means mounted on the top side of the frame at the distal end; and a distal yoke means mounted on the vertical adjustment means for supporting the barrel end of the gun, wherein a vertical angle of a sighting line extending from the rifle in the rest with respect to horizontal is changed by adjusting the distal yoke on the vertical adjustment means to raise or lower the barrel end the rifle and wherein a horizontal angle of the sighting line is changed by rotating the frame on the rotatable bearing of the support means.

In further embodiments of the rest the vertical adjustment means comprises a ramp attached upon the top side of the frame having a ramp angle vertical with respect to the horizon such that a height of the distal yoke above the frame is adjusted by sliding the distal yoke along the ramp. In still further embodiments the rest further comprises one or more wedges held between the mounting plate and the wall of the hunting blind when the gun rest in mounted to offset the vertical sighting angle of the gun in the rest with respect to the horizon. In still further embodiments the proximal yoke is V-shaped, such that the butt end of the stock can be supported at various places along a length of the butt end to change the vertical angle of a sighting line. In still further embodiments the fixed surface is part of a hunting blind. In still further embodiments the fixed surface is a wall of the hunting blind.

The present invention provides a method of using a rifle rest in firing a rifle having a stock with a butt end and a barrel end, the method comprising: providing a rest for steadying a rifle to be fired comprising a mounting means for mounting of the rest on a fixed surface; a support means with ends, a first end of which is affixed to the mounting means and with a rotatable bearing means which provides for rotation of a rotating portion of the support means at a second end on a vertical axis; a frame with a proximal end and a distal end, the proximal end cantilevered on the rotating portion of the support means which is mounted at the distal end of the frame, the frame having a top side and a bottom side; a proximal yoke means for supporting the butt end of the rifle on the proximal end of the frame; a vertical adjustment means mounted on the top side of the frame at the distal end; and a distal yoke means mounted on the vertical adjustment means for supporting the barrel end of the rifle, wherein a vertical angle of a sighting line extending from the rifle in the rest with respect to horizontal is changed by adjusting the distal yoke on the vertical adjustment means to raise or lower the barrel end the rifle and wherein a horizontal angle of the sighting line is changed by rotating the frame on the rotatable bearing of the support means; adjusting distal yoke on the vertical adjustment means to raise or lower the distal yoke so as to change the vertical angle of the sighting line of the rifle; and rotating the frame of the rest so as to change the horizontal angle of the sighting line of the rifle.

In further embodiments of the method the step of adjusting the adjustment means to change the vertical sighting angle of the gun in the rest with respect to the horizon is accomplished by sliding the distal yoke on a ramp. In still further embodiments the method further comprises the step of inserting one or more wedges between the mounting plate and the hunting blind to offset the vertical sighting angle of the gun in the rest with respect to the horizon. In still further embodiments the method further comprises sliding the butt end of the stock more proximally or distally along the proximal yoke to change the vertical angle of a sighting line.

The present invention provides a method of firing a handheld long gun having a stock with a butt end and a barrel end comprising: providing a rest for steadying the gun comprising a mounting means for mounting of the rest on a fixed surface; a support means with ends, a first end of which is affixed to the mounting means and with a rotatable bearing means which provides for rotation of a rotating portion of the support means at a second end on an upwardly oriented axis; a frame with a proximal end and a distal end, the proximal end cantilevered on the portion for rotation of the support means which is mounted at the distal end of the frame, the frame having a top side and a bottom side; a proximal yoke means for supporting the butt end of the gun on the proximal end of the frame; and a distal yoke means mounted on the top side of the distal end of the frame for supporting the barrel end of the stock of the gun, wherein a horizontal angle of a sighting line of the gun in the rest is changed by rotating the frame on the rotatable bearing of the support means; positioning the gun by changing a vertical or horizontal sighting angle of the gun on the frame; and firing the gun at a preselected target.

DETAILED DESCRIPTION OF THE INVENTION

Figure 1:
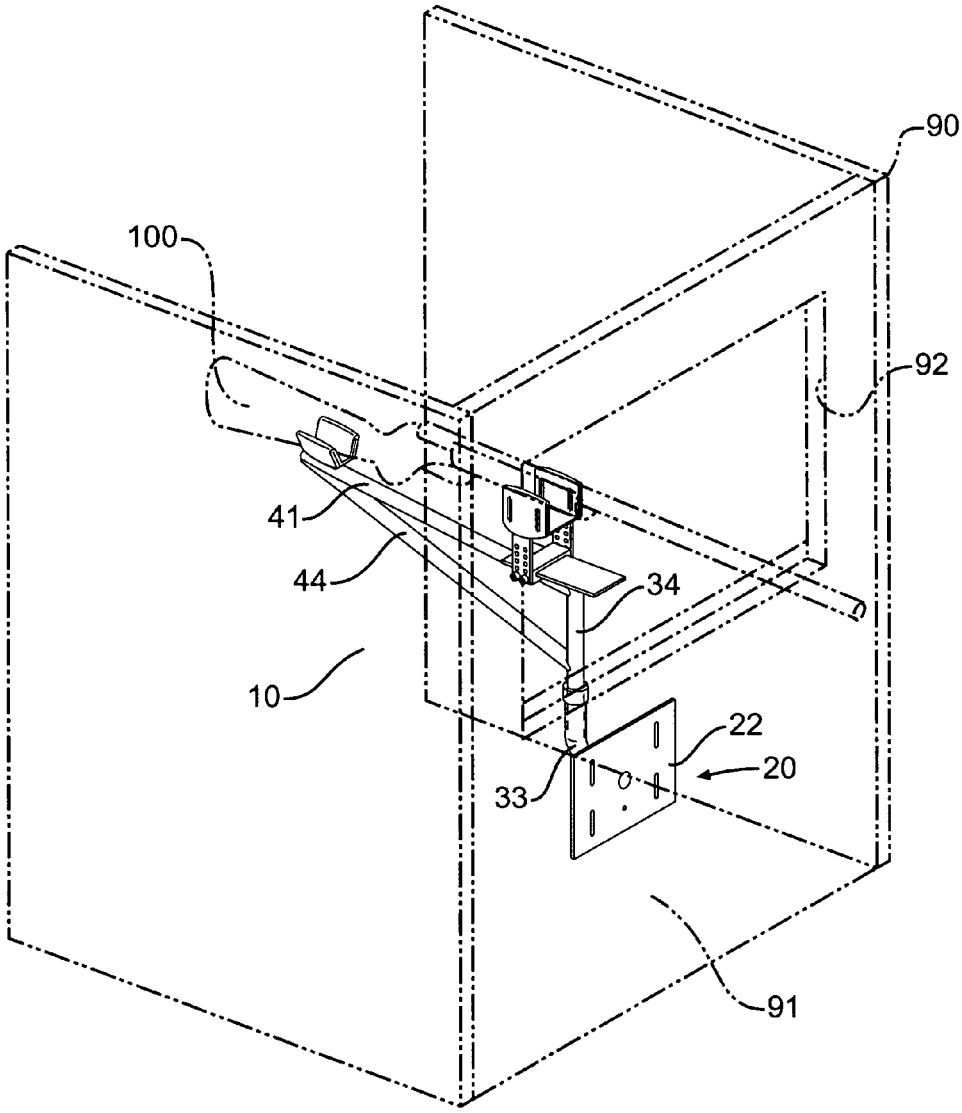
FIG. 1 illustrates a perspective view of the gun rest 10 mounted to a wall in a hunting blind.

All patents, patent applications, government publications, government regulations, and literature references cited in this specification are hereby incorporated herein by reference in their entirety. In case of conflict, the present description, including definitions, will control.

The term "long gun" as used herein refers to a handheld weapon with a shoulder butt stock which forces a projectile by means of a fluid out of a barrel.

The term "firearm" as used herein refers to a gun where the projectile is fired by an explosive reaction.

The term "rifle" as used herein refers to a gun, which preferably has a butt stock and a forearm, where the barrel has rifling and is the preferred type of weapon for which the present invention is adapted.

The term "proximal" as used herein refers to an end of the rest which is nearest to the user during operation.

The term "distal" as used herein refers to the end opposite of proximal, which is farthest from the user during operation.

The term "sighting line" as used herein refers to a line which extends along a central axis through the barrel of the gun.

The term "vertical angle" is the angle which the sighting line makes as it extends from the gun in the rest with respect to a horizontal line.

The term "horizontal angle" is the angle which the sighting line makes in a horizontal plane as it extends from the gun in the rest with respect to a previous sighting line, as the frame is rotated on the vertical axis of the rotatable bearing of the support means.

The term "mounting means" as used herein refers to any mechanism known in the art for supporting the rest on a fixed support. Some examples of a mounting means include a plate which can be bolted, screwed, or otherwise affixed to a flat surface such as a wall or floor of a hunting blind. The term "mounting means" however is not limited to a mechanism which can be affixed to a flat surface. It also encompasses any means to support the gun rest such as the utilization of sand bags to hold a part of the rest, or other means to hold the gun rest in place. Other examples include shafts or spikes which can be driven into solid surfaces such as rock and wood.

The term "yoke" as used herein refers to a mechanism which provides at least vertical and lateral support to the long gun in the gun rest.

The present invention provides a rest for steadying a gun during firing which has a stock with a butt end and a barrel end. The gun rest can be used with handheld long guns including gas driven guns (air and carbon dioxide or other gases), as well as firearms such as rifles or smooth bore shotguns. The rest comprises a mounting means for mounting of the rest on a fixed surface to hold the rest steady during aiming and firing of the gun. A support means which has a first end affixed to the mounting means is provided with a rotatable bearing means such that a rotating portion of the support means can turn side to side horizontally during aiming at a fixed target or following a moving target. A frame which is cantilevered on the rotating portion of the support means has a proximal yoke means for supporting the butt end of the gun on the proximal end of the frame. A distal yoke means is mounted on the top side of the distal end of the frame for supporting the barrel end of the gun. The sighting line of the gun along the axis of the barrel of the gun in the rest is changed horizontally by rotating the frame on the rotatable bearing of the support means, while the gun can be moved forward or backward to quickly adjust the vertical angle of the sighting line. More preferably, the barrel end of the gun can be raised or lowered by a vertical adjustment portion provided between the distal yoke and the rotating portion of the support means.

One embodiment of the gun rest is illustrated in FIGS. 1–8, showing the gun rest 10 having a frame 40 cantilevered on a rotating portion 34 of a support 30. The rest 10 supports the butt end of a stock of the gun upon a proximal yoke 50 at a proximal end 47 of the frame 40 and the barrel end of the stock of the gun upon a distal yoke 70 mounted upon the rotating portion 34 of the support 30 at a distal end 48 of the frame 40. Since there is no butt plate provided on the rest 10, the user can freely slide the gun forwards towards the distal end 48, and backwards towards the proximal end 47 while the gun is still supported upon the rest so as to quickly adjust the vertical aim of the gun. Preferred embodiments of the rest 10 provide a vertical adjustment portion 60 for fine adjustment of the vertical aim of the gun which is especially critical with long range targeting. Additionally, the user can rotate the gun upon the rest 10 to quickly adjust the horizontal aim of the gun and track a moving target.

Figure 3:
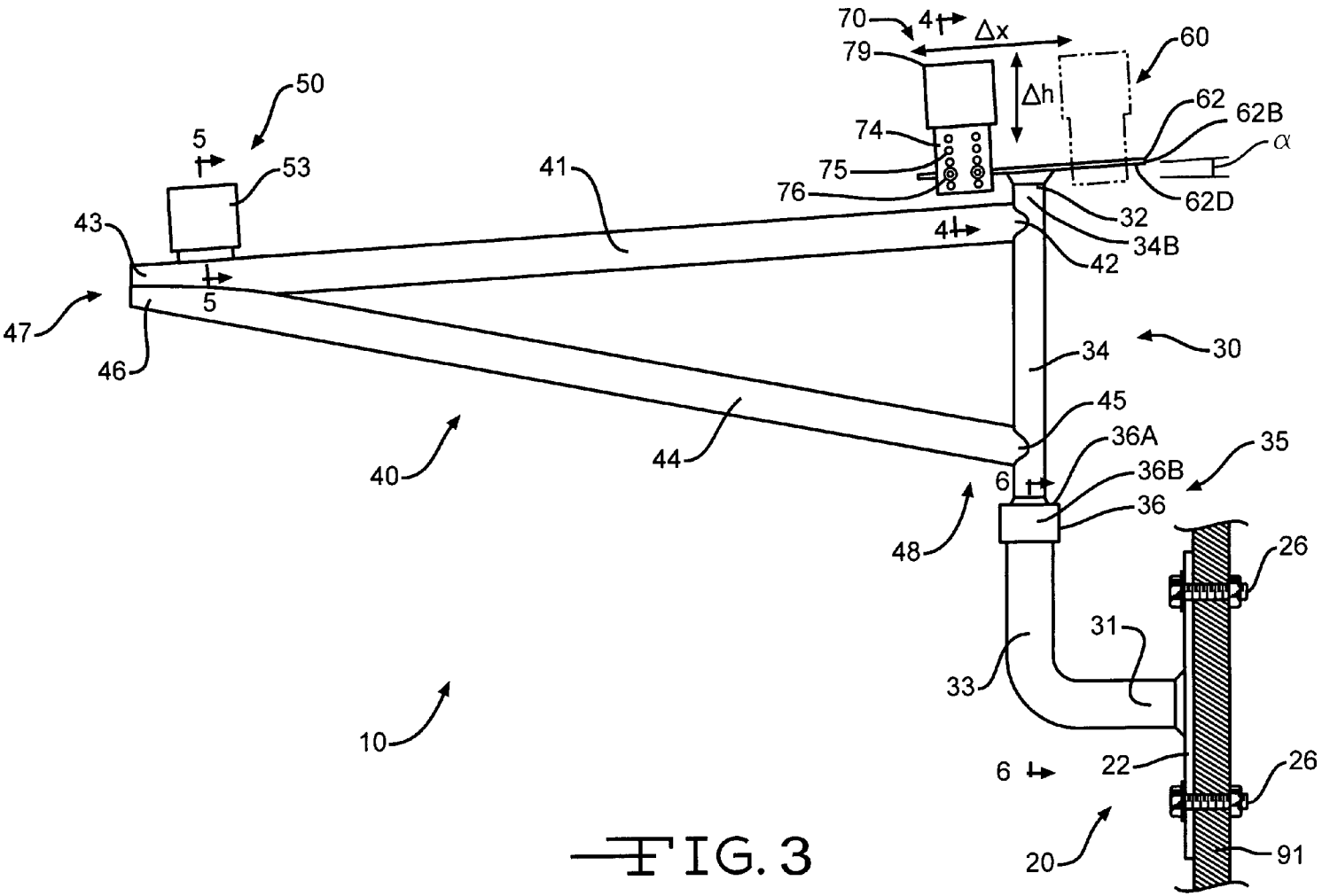
FIG. 3 illustrates a side view of the gun rest 10.

As illustrated in FIG. 1, the rest 10 is used to steady a gun 100 such as a rifle during firing by securely mounting a mounting portion 20 of the rest 10 to a stable structure, such as a hunting blind 90. While the mounting portion 20 of the rest 10 in FIG. 1 comprises a mounting plate 22 for attachment to a planar surface, other mounting portions which can secure the gun rest to a stable structure or object is encompassed by the present invention. In a preferred embodiment, a mounting portion 20 of the rest has a mounting plate 22 which is used as a means to mount the rest 10 on a fixed surface, such as a wall 91 of a hunting blind 90. The mounting plate 22 further has attachment slots to receive attachment bolts 26 which pass through the attachment slots 24 and the wall 91 or other fixed surface as seen in FIG. 3 to secure the rest 10 to the wall 91. When the rest 10 is mounted in a hunting blind 90, the rest 10 is mounted upon a wall 91 having a window 92 above the mounting portion 20 so that the gun 100 can be fired out of the window 92 while the user remains concealed within the hunting blind 90.

Figure 2:
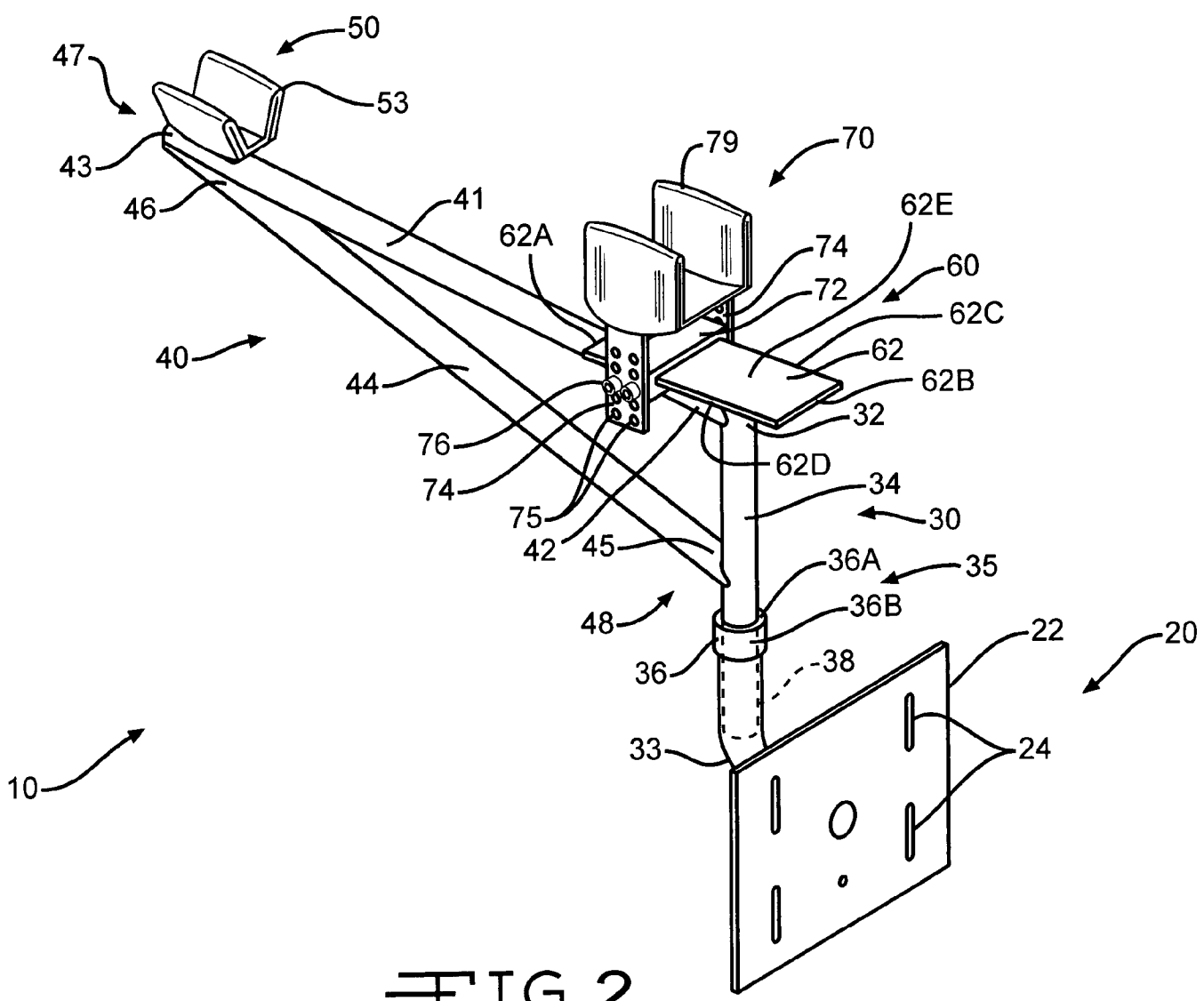
FIG. 2 illustrates a perspective view of the gun rest 10.

FIG. 2 illustrates a perspective view and FIG. 3 a side view showing the rest 10 in detail. A base portion 33 of a support 30 projects from the mounting plate 22 of the mounting portion 20 at a plate end 33B of the base portion 33. The base portion 33 of the support 30 is attached to the mounting plate 22 at a first end 31 of the support 30. The base portion 33 rotatably supports the rotating portion 34 of the support 30 disposed at a second end 32 of the support 30. The cylindrical rotating portion 34 is rotatably mounted in an upward orientation into an opening 33D in a hollow cylindrical bearing end 33C of the base portion 33 by means of a rotatable bearing 32, best seen in FIG. 6. The rotating portion 34 has an insert 38, having an cylindrical external surface 38A defined from a bottom end 34A of the rotating portion 34A to an annular ring top 36A of a cap 36 surrounding the cylindrical rotating portion 34. The insert 38 is inserted into the opening 33D at the hollow cylindrical bearing end 33C so that the bearing end 33C of the base portion 33 rests against the top 36A of the cap 36. The cap 36 has sides 36C projecting from an outer rim of the top 36A of the cap 36 which fit over the bearing end 33C of the base portion 33. The cylindrical external surface 38A of the insert 38 slides smoothly against the internal surface 33A within the opening 33D of the hollow cylindrical bearing end 33C to provide a rotatable bearing for the rotation of the rotating portion 34 of the support 30.

Figures 7, 8:
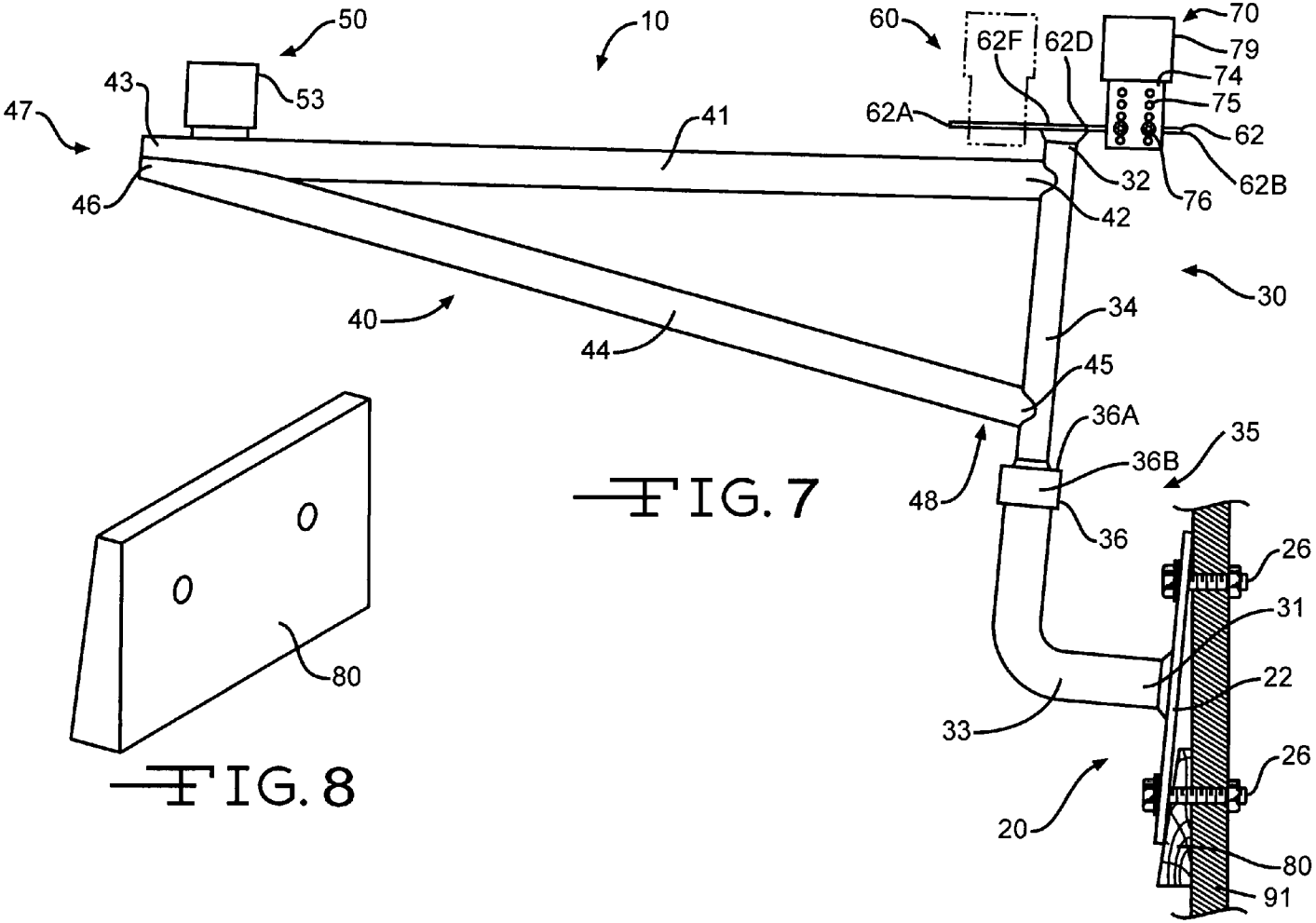
FIG. 7 illustrates a side view of the gun rest 10 mounted with a wedge 80.
FIG. 8 illustrates a perspective view of the wedge 80.

The lengthwise axis from bottom end 34A to top end 34B of the rotating portion 34 is vertically oriented when the rest 10 is mounted directly to a vertical fixed surface such as a wall of a hunting blind. Typically the rotating portion 34 is mounted vertically, however the user can mount the rest such that the rotating portion 34 is offset from vertical. One means to accomplish this is to insert one or more wedges 80 (FIG. 8) between the mounting plate 22 and the fixed support such as a wall 91 of a hunting blind 90 as illustrated in FIG. 7 to offset the rotating portion 34 from vertical. This offsets the vertical sighting angle of the gun in the rest with respect to the horizon.

A frame 40 is provided as a top beam 41 and a bottom beam 44 each of which are cantilevered at a distal end 47 of the frame 40 on the rotating portion 34 of the support 30. The top beam 41 has a first end 42 attached to the rotating portion 34 of the support 30 near to the top end 34B of the rotating portion 34 of the support 30, the top beam 41 extending to a second end 43 of the top beam 41 to provide a proximal end 48 of the frame 40. The bottom beam 44 has a first end 42 attached near the rotatable bearing 35 at the bottom end 34A of the rotating portion 34 of the support 30 and extends to a second end 43 at a proximal end 47 of the frame 40.

Figure 5:
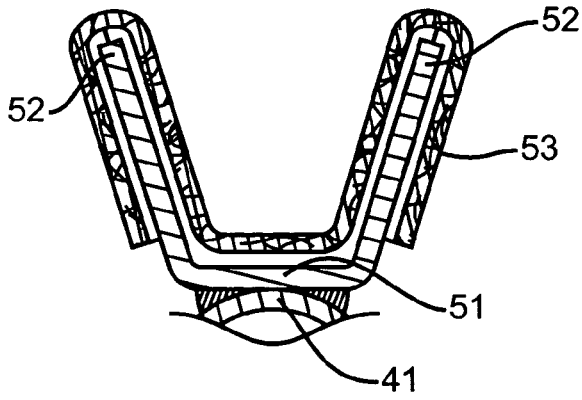
FIG. 5 illustrates a cross-sectional view of the proximal yoke 50 taken along line 5—5 of FIG. 3.
Figure 6:
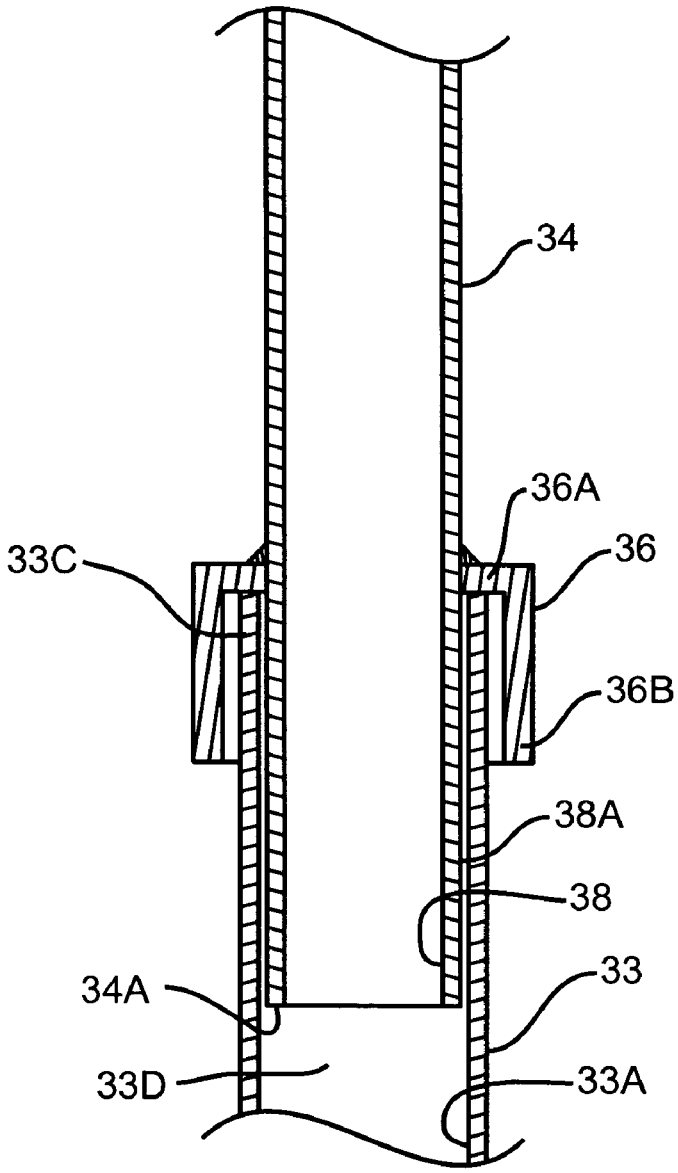
FIG. 6 illustrates a cross-sectional view of the support 30 taken along line 5—5 of FIG. 3 showing the rotational bearing.

A proximal yoke is mounted at the proximal end 47 of the frame 40 on the second end 43 of the top beam 41. As best seen in FIG. 5, the proximal yoke 50 is a V-shaped plate configured to provide a base 51 upon which the butt end of the stock of the gun 100 is securely supported between two sides 52 of the plate comprising the proximal yoke 50. Preferably, the proximal yoke 50 has a soft proximal yoke cover 53 comprising leather or other material which can snugly fit over the yoke 53 to protect the stock of the gun from damage. The proximal yoke 50 is configured to allow the user to easily slide the butt end of the stock of a gun more proximally or distally along the proximal yoke. The angle of the butt end of the stock of the gun, as the gun is moved more backward proximally or forward distally along the frame 40 can be utilized to adjust the vertical angle of the sighting line of the gun 100 with respect to the horizon.

Figure 4:
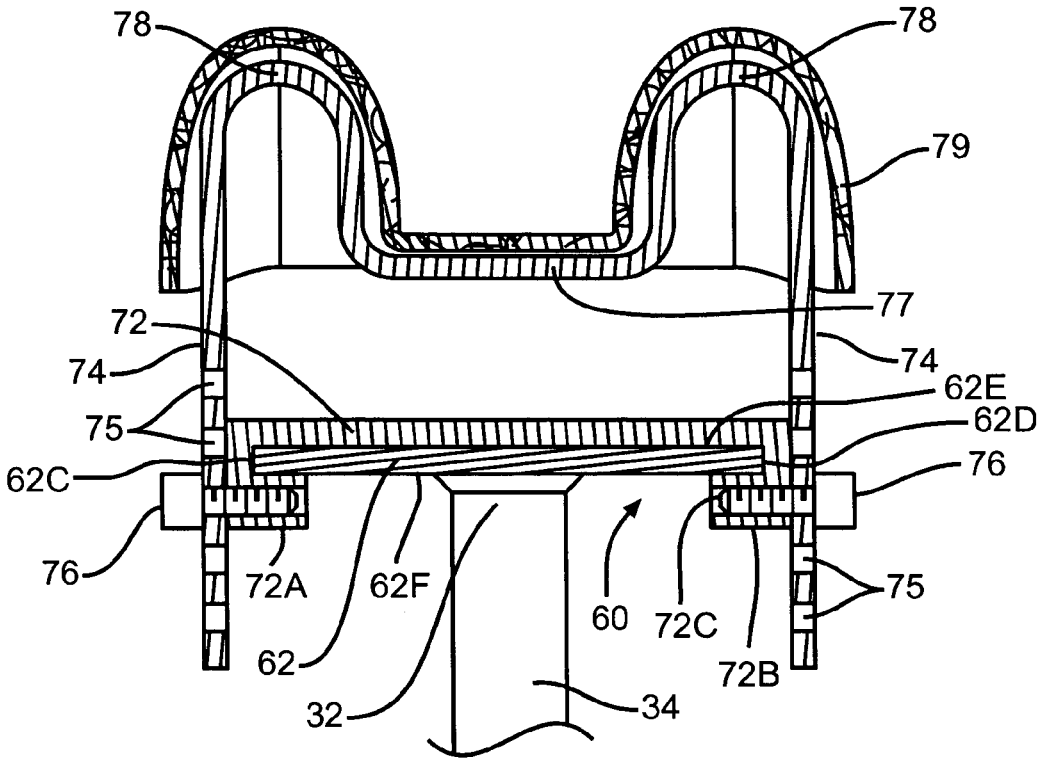
FIG. 4 illustrates a cross-sectional view of the distal yoke 70 taken along line 4—4 of FIG. 3.

A distal yoke 70 is mounted to the top end 34B rotatable portion 34 of the support 30, preferably by means of a vertical adjustment portion 60, as best illustrated in FIGS. 2 and 4. The distal yoke 70 is comprised of a distal yoke plate 74 having a first side 74A and a second side 74B. The distal yoke plate 74 is a rectangular strip which is bent between the sides (74A, 74B) such that it is configured with a yoke base 77 upon which the barrel end of the gun is rested provided between two sides 78. Preferably, the distal yoke 70 also has a soft distal yoke cover 79 comprising leather or other material which can snugly fit over the distal yoke plate 74 to protect the stock of the gun from damage.

The vertical adjustment portion 60 comprises a slide 72 slidably mounted upon a ramp 62 attached at the top end 34B of the rotating portion 34 of the support 30 and adjacent to the distal end 48 of the frame 40. The ramp 62 with a top face 62E and a bottom face 62F, each having a length defined by a first edge 62A and a second edge 62B and a width defined by a third edge 62C and a fourth edge 62D, is angularly mounted on the bottom face to the top end 34B of the rotating portion 34 of the support 30. As seen in cross-section in FIG. 4, the slide 72 grips the width of the ramp 62 with first runner 72A fitting over a third edge 62C of the ramp 62 and a second runner 72B fitting over a fourth edge 62D of the ramp 62. The ramp 62 is mounted with the first edge 62A lower than the second edge 62B of the ramp 62. The ramp 62 is thereby mounted at a vertical ramp angle $\alpha$ (FIG. 3) between a line running through the first edge 62A and the second edge 62B and a horizontal line.

The distal yoke 70 is attached to the vertical adjustment portion 60 by means of a number of fastening means such as Allen screws 76. Other fastening means known in the art can be used to attach the distal yoke plate 74. Two Allen screws attach the first side 74A of the distal yoke plate 74 to the first runner 72A and two more Allen screws attach the second side 74B of the distal yoke plate 74 to the second runner 72B by passing through holes 75 in the distal yoke plate 74 and into threaded holes 72C adapted to receive the Allen screws 76 in the first runner 72A and second runner 72B of the slide 72. While the Figures illustrate an embodiment having multiple sets of holes 75 in the distal yoke plate 74 so that the distal yoke plate 74 can be mounted with the yoke base 77 positioned at different heights above the slide 72, an embodiment having only one set of holes so that the distal yoke plate 74 can be mounted with the yoke base 77 positioned only at one height above the slide 72 is also encompassed by the present invention. The slide 72 fits loosely enough to the ramp 62 so that it is free to move in a sliding manner along the length of the ramp 62 between the first edge 62A and the second edge 62B. By sliding along the length of the ramp 62 the height of the distal yoke 70 above the mounting plate can be adjusted.

As the distal yoke 70 and thereby the slide 72 is moved back proximally towards the first edge 62A or forward distally towards second edge 62B along the ramp 62 the distal yoke is lowered or raised in height, respectively. The distal yoke 70 has an incremental change in height $\Delta h$ when it is moved an incremental distance $\Delta x$ along the length of the ramp 62. In a preferred embodiment, the ramp is mounted such that the ramp angle $\alpha$ is five degrees (5°) with respect to horizontal. At this ramp angle $\alpha$, when the distal yoke 70 is moved an incremental distance $\Delta x$ of one quarter (¼) inch (6.35 mm) there is approximately a two foot (0.61 m) vertical change in targeting at 150 yards (137.16 m).

In use, the rotating portion 34 of the support 30 allows the user to rotate the gun resting on the frame 40 of the rest 10 to adjust the horizontal angle of the sighting line of the gun for the purpose of aiming at a target. The butt end of the stock of the gun in the rest can be supported at various places along a length of the butt end to change the vertical angle of the sighting line with respect to the horizon. In preferred embodiments of the gun rest, the vertical adjustment portion 60 such as the ramp 62 and the slide 72 is provided between the rotating portion 34 of the support 30 and the distal yoke 70. The vertical adjustment portion 60 allows the user to adjust the elevation of the barrel end of the stock of the gun on the rest to change the vertical angle of the gun sighting line with respect to the horizon for fine adjustment of the aim of the gun.

The distal yoke 70 supports the barrel end of the stock of the gun 100. The vertical angle of a sighting line which extends from the rifle in the rest with respect to a horizontal can be changed by adjusting the distal yoke on the vertical adjustment ramp to raise or lower the barrel end the rifle. The horizontal angle of the sighting line can be changed by rotating the frame on the rotatable bearing of the support means. The gun rest 10 can be rotated horizontally 180° to allow for sighting along any horizontal angle with respect to the wall.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the Claims attached herein.

I claim:

1. A rest for steadying a handheld long gun during firing having a stock with a butt end and a barrel end, comprising:

(a) a mounting means for mounting of the rest on a fixed surface;

(b) a support means with ends, a first end of which is affixed to the mounting means and with a bearing means which provides a rotating portion on the support means at a second end on an upwardly oriented axis;

(c) a frame with a proximal end and a distal end, the proximal end cantilevered on the portion for rotation of the support means which is mounted at the distal end of the frame, the frame having a top side and a bottom side;

(d) a proximal rest means for providing at least vertical and lateral support for the butt end of the gun on the proximal end of the frame; and (e) a distal rest means slidably mounted on the top side of the distal end of the frame for providing at least vertical and lateral support for the barrel end of the stock of the gun and allowing vertical adjustment by moving the rest means on the distal end of the frame towards or away from the proximal end and distal end of the frame, wherein a horizontal angle of a sighting line of the gun in the rest is changed by rotating the frame on the rotatable bearing of the support means.

2. The rest of claim 1 further comprising one or more wedges to be held between the mounting means and the fixed surface when the rest is mounted to offset a vertical sighting angle of the gun in the rest with respect to the horizon.

3. The rest of claim 1 wherein the proximal rest means is V-shaped, such that the butt end of the stock can be supported at various places along the stock.

4. The rest of claim 1 wherein the rest is adapted to be mounted by the mounting means on the fixed surface which is part of a hunting blind.

5. The rest of claim 4 wherein the fixed surface is a vertically oriented wall of the hunting blind.

6. A rest for steadying a rifle during firing having a stock with a butt end and a barrel end, when the rifle is to be fired in a generally declined angular direction from horizontal comprising:

(a) a mounting means for mounting of the rest on a fixed surface;

(b) a support means with ends, a first end of which is affixed to the mounting means and with a bearing means which provides of a rotating portion on the support means at a second end on an upwardly oriented axis;

(c) a frame with a proximal end and a distal end, the proximal end cantilevered on the rotating portion of the support means which is mounted at the distal end of the frame, the frame having a top side and a bottom side;

(d) a proximal rest means for providing at least vertical and lateral support for the butt end of the rifle on the proximal end of the frame;

(e) a vertical adjustment means mounted on the top side of and at an inclined angle to the frame at the distal end; and (f) a distal rest means mounted on the vertical adjustment means for providing at least vertical and lateral support for the barrel end of the stock of the rifle, wherein a vertical angle of a sighting line extending from the rifle in the rest with respect to horizontal is changed by adjusting the distal rest means on the vertical adjustment means by sliding the rest means at the inclined angle to the frame to raise or lower the barrel end of the rifle and wherein a horizontal angle of the sighting line is changed by rotating the frame on the rotatable bearing of the support means.

7. The rest of claim 6 wherein the vertical adjustment means comprises a ramp attached upon the top side of the frame having a ramp angle vertical with respect to the horizon such that a height of the distal rest means above the frame is adjusted by the sliding of the distal rest means along the ramp.

8. The rest of claim 6 further comprising one or more wedges to be held between the mounting plate and the wall of the hunting blind when the gun rest is mounted to offset the vertical sighting angle of the gun in the rest with respect to the horizon.

9. The rest of claim 6 wherein the proximal rest means is V-shaped, such that the butt end of the stock can be supported at various places along a length of the butt end to change the vertical angle of a sighting line.

10. The rest of claim 6 wherein the rest is adapted to be mounted by the mounting means on the fixed surface which is part of a hunting blind.

11. The rest of claim 10 wherein the fixed surface is a vertically oriented wall of the hunting blind.

12. A method of using a rifle rest in firing a rifle having a stock with a butt end and a barrel end, the method comprising:

(a) providing a rest for steadying the rifle to be fired comprising a mounting means for mounting of the rest on a fixed surface; a support means with ends, a first end of which is affixed to the mounting means and with a rotatable bearing means which provides a rotating portion on the support means at a second end on a vertical axis; a frame with a proximal end and a distal end, the proximal end cantilevered on the rotating portion of the support means which is mounted at the distal end of the frame, the frame having a top side and a bottom side; a proximal rest means for supporting the butt end of the rifle on the proximal end of the frame; a vertical adjustment means mounted on the top side of an inclined angle to the frame at the distal end; and a distal rest means slidably mounted on the vertical adjustment means for providing at least vertical and lateral support for the barrel end of the rifle, wherein a vertical angle of a sighting line extending from the rifle in the rest with respect to horizontal is changed by adjusting the distal rest means on the vertical adjustment means by sliding the rest means towards or away from the proximal end and distal end of the frame to raise or lower the barrel end of the rifle and wherein a horizontal angle of the sighting line is changed by rotating the frame on the rotatable bearing of the support means;

(b) adjusting the distal rest means on the vertical adjustment means by sliding the rest means towards or away from the proximal end and distal end of the frame to raise or lower the distal rest means so as to change the vertical angle of the sighting line of the rifle; and (c) rotating the frame of the rest so as to change the horizontal angle of the sighting line of the rifle.

13. The method of claim 12 wherein the step of adjusting the adjustment means to change the vertical sighting angle of the gun in the rest with respect to the horizon is accomplished by sliding the distal rest means on a ramp.

14. The method of claim 12 further comprising the step of inserting one or more wedges between the mounting plate and the hunting blind to offset the vertical sighting angle of the gun in the rest with respect to the horizon.

15. The method of claim 12 further comprising sliding the butt end of the stock more proximally or distally along the proximal rest means to change the vertical angle of a sighting line.

16. A method of firing a handheld long gun having a stock with a butt end and a barrel end at a preselected target comprising:

(a) providing a rest for steadying the gun comprising a mounting means for mounting of the rest on a fixed surface; a support means with ends, a first end of which is affixed to the mounting means and with a bearing means which provides a rotating portion on the support means at a second end on an upwardly oriented axis;

a frame with a proximal end and a distal end, the proximal end cantilevered on the portion for rotation of the support means which is mounted at the distal end of the frame, the frame having a top side and a bottom side; a proximal rest means providing at least vertical and lateral support for the butt end of the gun on the proximal end of the frame; and a distal rest means mounted on the top side of the distal end of the frame for providing at least vertical and lateral support for the barrel end of the stock of the gun and allowing vertical adjustment by sliding the rest means on the distal end of the frame towards or away from the proximal or distal end of the frame, wherein a horizontal angle of a sighting line of the gun in the rest is changed by rotating the frame on the rotatable bearing of the support means;

(b) positioning the gun by changing a vertical or horizontal sighting angle of the gun on the frame; and (c) firing the gun at the preselected target.

17. A rest for steadying a rifle during firing having a stock with a butt end and a barrel end, when the rifle is to be fired in a generally declined angular direction from horizontal comprising:

(a) a mounting means for mounting of the rest on a fixed surface;

(b) a support means with ends, a first end of which is affixed to the mounting means and with a bearing means which provides a rotating portion on the support means at a second end on an upwardly oriented axis;

(c) a frame with a proximal end and a distal end, the proximal end cantilevered on the rotating portion of the support means which is mounted at the distal end of the frame, the frame having a top side and a bottom side;

(d) a proximal support means for providing at least vertical and lateral support for the butt end of the rifle on the proximal end of the frame;

(e) a vertical adjustment means mounted on the top side of the frame at the distal end which slides on the frame, wherein the vertical adjustment means comprises a ramp attached to the top side of the frame having a ramp angle vertical with respect to the horizon such that a height of the distal rest means above the frame is adjusted by the sliding of the distal rest means along the ramp; and (f) a distal rest means mounted on the vertical adjustment means for the barrel end of the stock of the rifle, wherein a vertical angle of a sighting line extending from the rifle in the rest with respect to horizontal is changed by adjusting and sliding the distal rest means on the vertical adjustment means to raise or lower the barrel end of the rifle and wherein a horizontal angle of the sighting line is changed by rotating the frame on the rotatable bearing means on the support means.

18. The rest of claim 17 further comprising one or more wedges to be held between the mounting plate and a wall of a hunting blind when the gun rest is mounted to offset the vertical sighting angle of the gun in the rest with respect to the horizon.

19. The rest of claim 17 wherein the proximal rest means is V-shaped, such that the butt end of the stock can be supported at various places along a length of the butt end to change the vertical angle of a sighting line.

20. The rest of claim 17 wherein the rest is adapted to be mounted by the mounting means on the fixed surface which is part of a hunting blind.

21. The rest of claim 20 wherein the rest is adapted to be mounted on the fixed surface which when mounted is a vertically oriented wall of the hunting blind.

22. A method of using a rifle rest in firing a rifle having a stock with a butt end and a barrel end, the method comprising:

(a) providing a rest for steadying the rifle to be fired comprising a mounting means for mounting of the rest on a fixed surface; a support means with ends, a first end of which is affixed to the mounting means and with a bearing means which provides a rotating portion on the support means at a second end on a vertical axis; a frame with a proximal end and a distal end, the proximal end cantilevered on the rotating portion of the support means which is mounted at the distal end of the frame, the frame having a top side and a bottom side; a proximal rest means for providing at least vertical and lateral support for the butt end of the rifle on the proximal end of the frame; a vertical adjustment means mounted on the top side of the frame at the distal end which slides on the frame; and a distal rest means mounted on the vertical adjustment means for providing at least vertical and lateral support for the barrel end of the rifle, wherein a vertical angle of a sighting line extending from the rifle in the rest with respect to horizontal is changed by adjusting the distal rest means on the vertical adjustment means to raise or lower the barrel end of the rifle, wherein a horizontal angle of the sighting line is changed by rotating the frame on the bearing means of the support means and one or more wedges to be held between the mounting plate and the wall of the hunting blind when the gun rest is mounted to offset the vertical sighting angle of the gun in the rest with respect to the horizon;

(b) adjusting the wedges to offset the vertical angle of the gun in the rest;

(c) adjusting the distal rest means on the vertical adjustment means wherein the step of adjusting the adjustment means to change the vertical sighting angle of the gun in the rest which respect to the horizon; and (d) rotating the frame of the rest so as to change the horizontal angle of the sighting line of the rifle.

23. The method of claim 22 wherein the step of adjusting the adjustment means to change the vertical sighting angle of the gun in the rest with respect to the horizon is accomplished by sliding the distal support means on a ramp.

24. The method of claim 22 further comprising sliding the butt end of the stock more proximally or distally along the proximal support means to change the vertical angle of a sighting line.

25. A method of firing a handheld long gun having a stock with a butt end and a barrel end at a preselected target comprising:

(a) providing a rest for steadying the gun comprising a mounting means for mounting of the rest on a fixed surface; a support means with ends, a first end of which is affixed to the mounting means and with a bearing means which provides a rotating portion on the support means at a second end on an upwardly oriented axis; a frame with a proximal end and a distal end, the proximal end cantilevered on the rotating portion of the support means which is mounted at the distal end of the frame, the frame having a top side and a bottom side; a proximal rest means for providing at least vertical and lateral support for the butt end of the gun on the proximal end of the frame; a vertical adjustment means mounted on the top side of and at an inclined angle to the frame at the distal end; and a distal rest means slidably mounted on the vertical adjustment means for providing at least vertical and lateral support for the barrel end of the stock of the rifle, and allowing vertical adjustment by sliding the distal rest means at the inclined angle towards an away from the proximal end and distal end of the frame, wherein a vertical angle of a sighting line extending from the rifle in the rest with respect to horizontal is changed by adjusting the distal support means on the vertical adjustment means by the sliding to raise or lower the barrel end of the rifle and wherein a horizontal angle of the sighting line is changed by rotating the frame on the bearing means of the support means;

(b) positioning the gun by changing a vertical or horizontal sighting angle of the gun on the frame; and (c) firing the gun at the preselected target.

26. A rest for steadying a rifle during firing having a stock with a butt end and a barrel end, when the rifle is to be fired in a generally declined angular direction from horizontal comprising:

(a) a mounting means for mounting of the rest on a fixed surface;

(b) a support means with ends, a first end of which is affixed to the mounting means and with a bearing means which provides a rotating portion of the support means at a second end on an upwardly oriented axis;

(c) a frame with a proximal end and a distal end, the proximal end cantilevered on the rotating portion of the support means which is mounted at the distal end of the frame, the frame having a top side and a bottom side;

(d) a proximal rest means for providing at least vertical and lateral support for the butt end of the rifle on the proximal end of the frame;

(e) a vertical adjustment means mounted on the top side of the frame at the distal end; and (f) a distal rest means mounted on the vertical adjustment means for providing vertical and lateral support for the barrel end of the stock of the rifle, wherein a vertical angle of a sighting line extending from the rifle in the rest with respect to horizontal is changed by adjusting the distal rest means on the vertical adjustment means to raise or lower the barrel end of the rifle, wherein a horizontal angle of the sighting line is changed by rotating the frame on the bearing means of the support means and wherein one or more wedges are provided between the mounting plate and the wall of the hunting blind when the gun rest is mounted to offset the vertical sighting angle of the gun in the rest with respect to the horizon.

27. The rest of claim 26 wherein the vertical adjustment means comprises a ramp attached upon the top side of the frame having a ramp angle vertical with respect to the horizon such that a height of the distal rest means above the frame is adjusted by sliding the distal means along the ramp.

28. The rest of claim 26 wherein the proximal rest means is V-shaped, such that the butt end of the stock can be supported at various places along a length of the butt end to change the vertical angle of a sighting line.

* * * * *

UNITED STATES PATENT AND TRADEMARK OFFICE

CERTIFICATE OF CORRECTION

PATENT NO. : 7,188,445 B2
APPLICATION NO. : 11/128847
DATED : March 13, 2007
INVENTOR(S) : Kenneth J. Lehman It is certified that error appears in the above--identified patent and that said Letters Patent is hereby corrected as shown below:

Column 1, line 52, “180° wand then locked” should be --180° and then locked--.

Column 2, line 52, “barrel end the rifle” should be --barrel end of the rifle--.

Column 3, line 24, “barrel end the rifle” should be --barrel end of the rifle--.

Column 8, line 65, “which provides of a” should be --which provides a--.

Column 12, line 2, “rest which respect to” should be --rest with respect to--.

Column 12, line 35, “towards an away from” should be --towards and away from--.

Signed and Sealed this

Twenty-ninth Day of May, 2007

JON W. DUDAS
*Director of the United States Patent and Trademark Office*